US007252581B2

(12) United States Patent
Numata et al.

(10) Patent No.: US 7,252,581 B2
(45) Date of Patent: Aug. 7, 2007

(54) POWER TOOLS

(75) Inventors: Fumitoshi Numata, Anjo (JP); Ryo Sunazuka, Anjo (JP)

(73) Assignee: Makita Corporation, Anjo-shi (JP)

( * ) Notice: Subject to any disclaimer, the term of this patent is extended or adjusted under 35 U.S.C. 154(b) by 255 days.

(21) Appl. No.: 11/032,485

(22) Filed: Jan. 7, 2005

(65) Prior Publication Data

US 2005/0153636 A1 Jul. 14, 2005

(30) Foreign Application Priority Data

Jan. 8, 2004 (JP) ..... 2004-003362

(51) Int. Cl.
*B34B 55/04* (2006.01)
*H02K 7/14* (2006.01)

(52) U.S. Cl. ..... 451/359; 15/230.1; 310/62; 451/488

(58) Field of Classification Search ..... 15/230.1; 310/62, 63; 451/344, 354, 355, 356, 357, 451/358, 359, 456, 488; 173/217
See application file for complete search history.

(56) References Cited

U.S. PATENT DOCUMENTS 2,456,571 A * 12/1948 Turner et al. ..... 310/50
2,779,883 A * 1/1957 Schumann ..... 310/50
3,829,722 A * 8/1974 Rosenthal et al. ..... 310/50
4,142,120 A * 2/1979 Hallerback ..... 310/59
4,342,929 A * 8/1982 Horne ..... 310/43
4,580,460 A * 4/1986 Chang et al. ..... 74/409
5,007,172 A * 4/1991 Palm ..... 30/377
5,634,274 A * 6/1997 Ohkouchi et al. ..... 30/124
6,848,985 B2 * 2/2005 Lamprecht et al. ..... 451/453
6,971,456 B2 * 12/2005 Yamada et al. ..... 173/217

(Continued)

FOREIGN PATENT DOCUMENTS

DE 29 10 845 10/1980

(Continued)

OTHER PUBLICATIONS

European Search Report for Application No. 04030813.2-2316, dated Jan. 11, 2007.

*Primary Examiner*—Timothy V. Eley
(74) *Attorney, Agent, or Firm*—Lahive & Cockfield, LLP; Anthony A. Laurentano, Esq.

(57) ABSTRACT

It is accordingly an object of the invention to provide a technique of cooling a power tool which further improves cooling effectiveness of the power tool. According to the invention, a power tool is provided that includes a driving motor, a tool bit, a power transmitting mechanism, a tool body and a cooling fan. The power tool further includes first and second cooling air passages. The first cooling air passage is disposed within the tool body and flows cooling air into the tool body by using the cooling fan. The second cooling air passage is provided within the tool body and takes outside air into the tool body by using the flow of the cooling air through the first cooling air passage. The cooling air within the first cooling air passage can be cooled by mixing outside air taken into the tool body via the second cooling air passage and therefore, the cooling air can further effectively cool components within the power tool. As a result, cooling effectiveness of the power tool can be improved.

10 Claims, 5 Drawing Sheets

U.S. PATENT DOCUMENTS

| | | | | |
|---|---|---|---|---|
| 2004/0263008 | A1* | 12/2004 | Voigt et al. | 310/58 |
| 2005/0034883 | A1* | 2/2005 | Yamada et al. | 173/217 |

FOREIGN PATENT DOCUMENTS

| | | | |
|---|---|---|---|
| DE | 4238564 | A1 | 5/1994 |
| DE | 29622019 | U1 | 5/1998 |
| EP | 0345896 | B1 | 12/1989 |
| EP | 0984545 | B1 | 3/2000 |
| JP | 31-9496 | | 6/1931 |
| JP | 51-128380 | | 10/1976 |
| JP | 09-140095 | | 5/1997 |
| JP | 10-201205 | | 7/1998 |
| JP | 2002-018745 | | 1/2002 |

* cited by examiner

POWER TOOLS

BACKGROUND OF THE INVENTION

1. Field of the Invention

The present invention relates to a power tool and more particularly, to a technique of cooling the power tool.

2. Description of the Related Art

Japanese non-examined laid-open patent publication No. 10-201205 discloses a hand-held type electric disc grinder. According to the known grinder, a cooling fan is disposed within a motor housing and driven by a driving motor. Cooling air is introduced from the rear end of the motor housing and led forward by rotation of the cooling fan. Thereafter, the cooling air is discharged to the outside from an air outlet in the vicinity of a gear housing connected to the motor housing. The flow of the cooling air cools the driving motor, the motor housing, the power transmitting mechanism and the gear housing.

While the above-mentioned cooling technique can ensure cooling performance to some degree, further improvement of the cooling effectiveness is desired.

SUMMARY OF THE INVENTION

It is accordingly an object of the invention to provide a technique of cooling a power tool which further improves cooling effectiveness of the power tool.

According to the invention, a power tool is provided that includes a driving motor, a tool bit, a power transmitting mechanism, a tool body and a cooling fan. The power tool further includes first and second cooling air passages. The first cooling air passage is disposed within the tool body and flows cooling air into the tool body by using the cooling fan. The second cooling air passage is provided within the tool body and takes outside air into the tool body by using the flow of the cooling air through the first cooling air passage. Outside air taken into the tool body is mixed with the cooling air. Because the cooling air within the first cooling air passage can be cooled by mixing outside air taken into the tool body via the second cooling air passage, the cooling air can further effectively cool components within the power tool. As a result, cooling effectiveness of the power tool can be improved. Other objects, features and advantages of the present invention will be readily understood after reading the following detailed description together with the accompanying drawings and the claims.

DETAILED DESCRIPTION OF THE INVENTION

Figure 1:
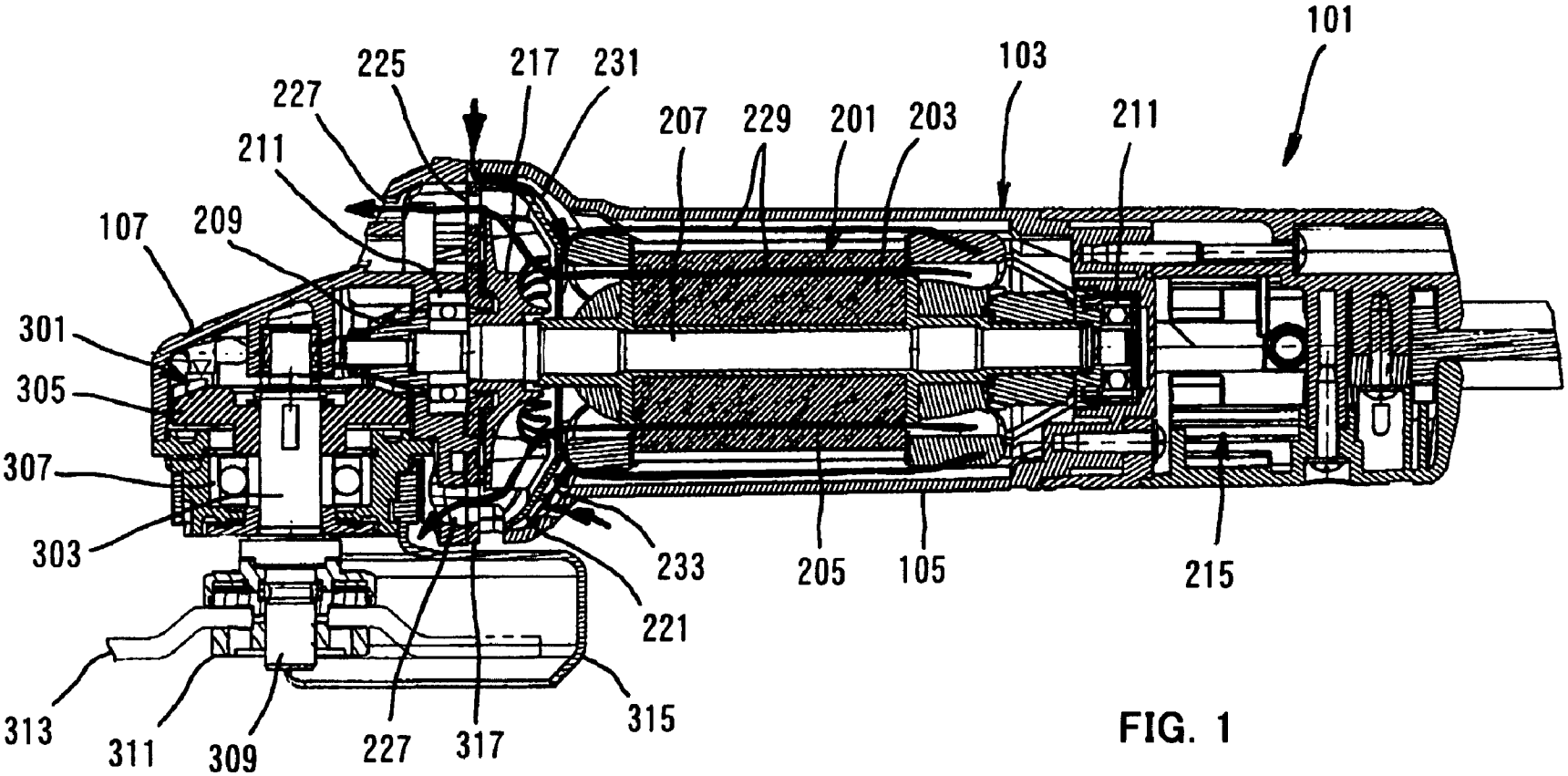
FIG. 1 is a sectional view showing an entire hand-held electric disc grinder according to the first representative embodiment of the invention.

The representative power tool may include a driving motor, a tool bit, a power transmitting mechanism, a tool body, a cooling fan and first and second cooling air passages. The tool bit performs a predetermined operation on a workpiece. The tool bit may typically refer to an electric disc grinder that performs a polishing or grinding operation on a workpiece by rotating a tool bit in the form of a grinding wheel. Further, it also embraces other power tools such as reciprocating saw, chain saw, hammer and hammer drill. The power transmitting mechanism transmits the output of the driving motor to the tool bit. The tool body houses the driving motor and the power transmitting mechanism. The tool body typically includes a motor housing for housing the driving motor and a gear housing for housing the power transmitting mechanism. Preferably in such case, both housings may be fixedly connected to each other. The cooling fan is disposed within the tool body. As the cooling fan, a centrifugal fan or an axial fan may be suitably utilized.

First cooling air passage is disposed within the tool body and flows cooling air into the tool body by using the cooling fan. The second cooling air passage is provided within the tool body and takes outside air into the tool body by using the flow of the cooling air through the first cooling air passage to mix the outside air with the cooling air. According to the invention, the cooling fan causes cooling air to flow within the tool body through the first cooling air passage and outside air is taken into the tool body through the second cooling air passage by utilizing the flow of the cooling air through the first cooling air passage. The outside air taken into the tool body may be mixed with the cooling air in the first cooling air passage. The intake of outside air into the second cooling air passage may be typically achieved by back pressure defined by pressure difference between the atmosphere and the second cooling air passage. Such back pressure may be caused by the flow of the cooling air through the first cooling air passage.

Preferably, the cooling air flowing through the first cooling air passage may flow downstream after cooling the driving motor. The cooling air is heated by cooling the driving motor. In this connection, according to the invention, low-temperature outside air can be taken into the tool body through the second cooling air passage and mixed with the heated cooling air so as to cool the heated cooling air. Thereafter, the cooled cooling air can flow downstream and can cool downstream components of the power tool. The downstream components here may refer to the power transmitting mechanism and the housing that houses the power transmitting mechanism. Thus, entire power tool can be efficiently cooled and the cooling effectiveness can be improved.

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 2:
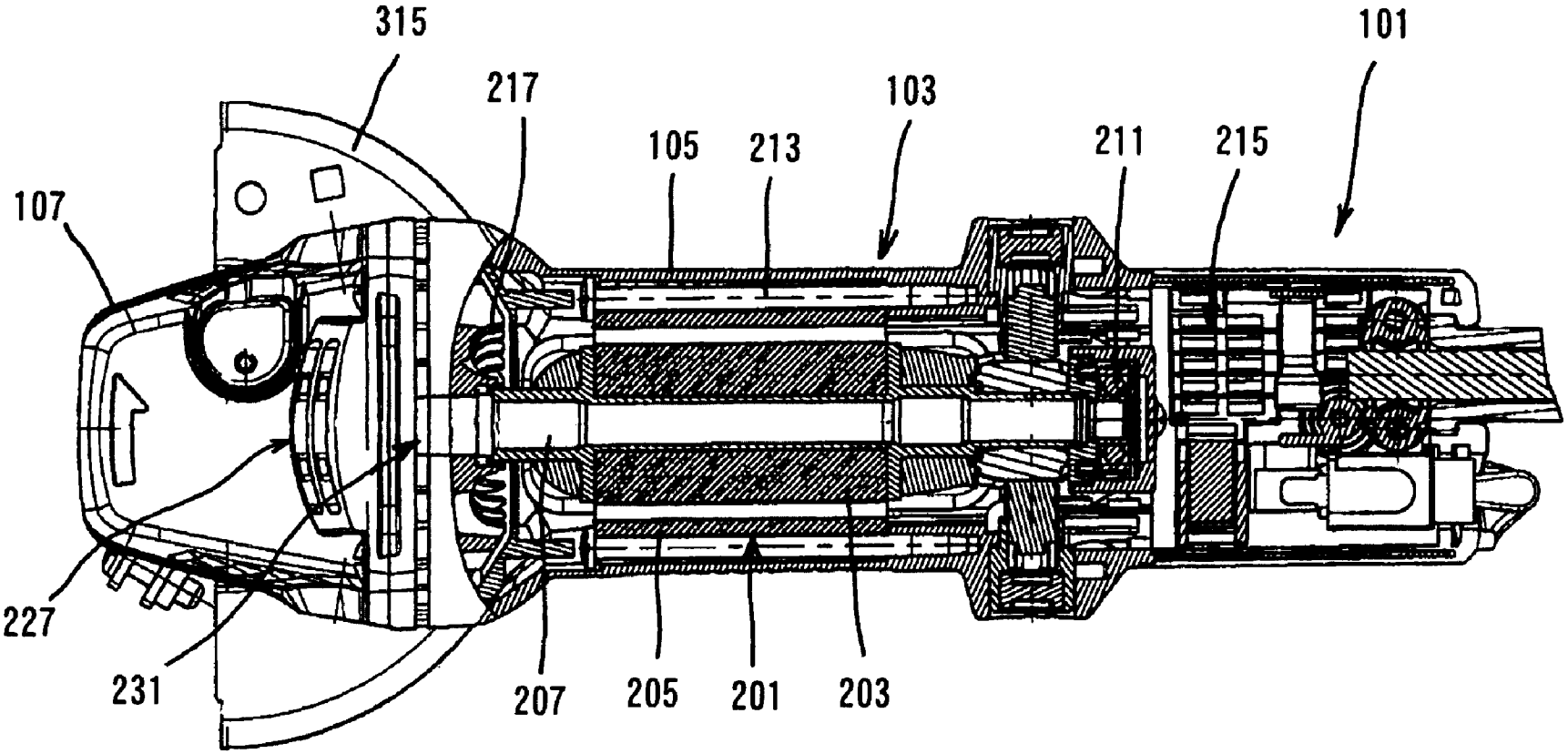
FIG. 2 is a plan view, partly in section, showing the entire electric disc grinder, with its rear portion shown in section.
Figure 3:
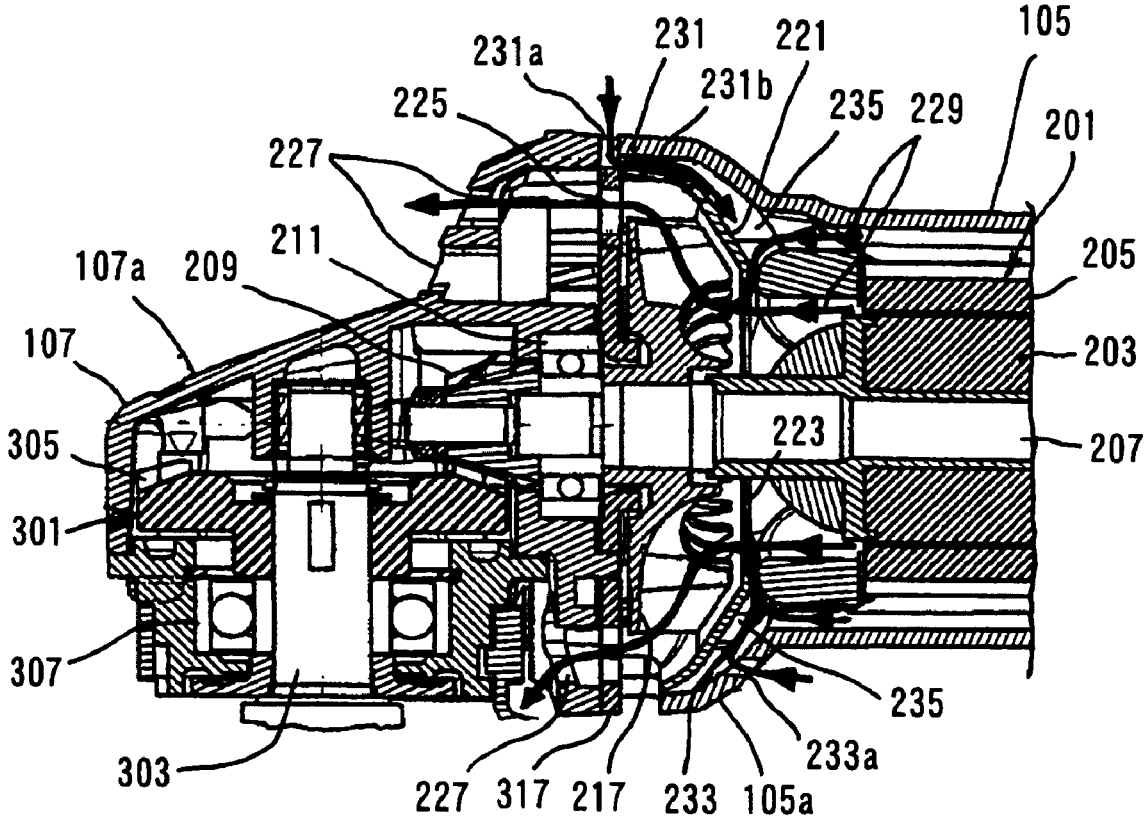
FIG. 3 is an enlarged partial view showing the second passage for intake of outside air.

First embodiment of the present invention will be explained with reference to FIGS. 1 to 3. In this embodiment, a hand-held portable electric disc grinder as an example of the representative power tool is provided. The representative disc grinder is used to polish or grind various kinds of workpiece, such as metal, concrete and stone. The disc grinder 101 includes a body 103 having a motor housing 105 and a gear housing 107. The body 103 is a feature that corresponds to the "tool body" according to the invention. The motor housing 105 is generally cylindrically shaped and houses an electric motor 201. The electric motor 201 includes a rotor 203 and a stator 205. The rotor 203 is rotatably disposed within the motor housing 105 and the stator 205 is fastened within the motor housing 105 by fastening devices such as screws 213. The electric motor 201 is disposed such that the direction of the axis of rotation of the rotor 203 corresponds to the longitudinal direction of the disc grinder 101. An output shaft 207 of the motor 201 extends generally horizontally in the longitudinal direction of the disc grinder 101. Bearings 211 support the rear end and the front end (the right end and the left end, respectively, as viewed in FIG. 1) of the output shaft 207. Around the front end portion of the output shaft 207, a driving side bevel gear 209 is integrally formed and a cooling fan 217 is mounted such that it can rotate together with the output shaft 207. Further, other than the electric motor 201, the motor housing 105 houses an electrical device 215 such as a controller for controlling the motor.

The gear housing 107 is connected to the front end of the motor housing 105 and houses a power transmitting mechanism 301. The power transmitting mechanism 301 transmits the output of the driving motor 105 to a grinding wheel 313. The power transmitting mechanism 301 mainly includes the driving side bevel gear 209, a driven side bevel gear 305 and a spindle 303. The spindle 303 extends generally vertically in a direction perpendicular to the output shaft 207 of the motor 201 and is rotatably supported by a bearing 307. The driven side bevel gear 305 is mounted around the upper end portion of the spindle 303 such that it can rotate together with the spindle 303 in one piece. The driven side bevel gear 305 engages the driving side bevel gear 209 of the output shaft 207 that extends into the gear housing 107. The lower end portion of the spindle 303 protrudes from the gear housing 107. A grinding wheel mounting portion 309 is formed on the protruded end of the spindle 303. The grinding wheel 313 is mounted to the grinding wheel mounting portion 309 via a grinding wheel holder 311. A cover 315 covers the rear half of the grinding wheel 313. The grinding wheel 313 is a feature that corresponds to the "tool bit" according to the invention.

The motor housing 105 is generally cylindrically shaped and forms a handgrip that the user holds during the working (polishing or grinding) operation. A switch knob (not shown) is provided in a predetermined position on the outer periphery of the motor housing 105 and can be operated to drive the electric motor 201. When the motor 201 is driven by operation of the switch knob, the output of the motor 201 is transmitted from the output shaft 207 to the grinding wheel 313 via the driving side bevel gear 209, the driven side bevel gear 305 and the spindle 303. Thus, the grinding wheel 313 is rotated, so that the operation of polishing or grinding the workpiece can be performed.

Further, an inlet (not shown) is formed in the rear end portion (the right end portion as viewed in FIG. 1) of the motor housing 105 and air for cooling the electric motor 201 is taken in through the inlet. When the electric motor 201 is driven, outside air is allowed to flow into the motor housing 105 through the inlet by the suction force which is caused by rotation of the cooling fan 217. Thus, the cooling fan 217 causes the cooling air to flow within the motor housing 105. The cooling fan 217 is a centrifugal fan, and a baffle plate 221 is disposed at the rear of the cooling fan 217 such that it covers the cooling fan 217. The baffle plate 221 is formed of synthetic resin in one piece and has a generally bowl-like shape. An air hole 223 (see FIG. 3) is formed in the center of the baffle plate 221.

As shown by arrows in FIG. 1, the cooling air that has been taken into the motor housing 105 through the inlet by the suction force of the cooling fan 217 flows forward (toward the gear housing 107) through the clearance between the rotor 203 and the stator 205 and the clearance between the stator 205 and the inside wall surface of the motor housing. As a result, the driving motor 201 is cooled down. The cooling air that has passed along the driving motor 201 is drawn from the rear side of the baffle plate 221 into the inside of the baffle plate 221 via the air hole 223. Thus, the cooling air is narrowed via the air hole 223. Thus, the amount and pressure of the cooling air in the inside of the baffle plate 221 increase. With the momentum, the cooling air flows forward along the inside surface of the baffle plate 221 and is discharged to the outside through an opening 225 of a retainer 317 and air outlets 227 of the gear housing 107. The retainer 317 is disposed in the joint between the gear housing 107 and the motor housing 105 when they are butt-joined together. The retainer 317 retains the bearing 211 that is disposed on the side of the gear housing 107.

The air outlets 227 are formed in the upper and lower portions of the gear housing 107. The cooling air discharged through the upper air outlet 227 is blown toward a front upper surface 107*a* of the gear housing 107. The cooling air discharged through the lower air outlet 227 is blown onto the upper surface of the cover 315 that covers the grinding wheel 313. Thus, the cooling air that has been taken into the motor housing 105 through the inlet flows through a passage 229 defined by the clearance between the rotor 203 and the stator 205 of the motor 201, the clearance between the stator 205 and the inside wall surface of the motor housing, the air hole 223 of the baffle plate 221, the openings 225 and the air outlets 227. The passage 229 is a feature that corresponds to the "first cooling air passage" according to the invention. The passage 229 is hereinafter referred to as the first passage.

Further, second passages 231, 233 are formed on the upper and lower surface sides of the body 103. Outside air is taken in through the second passages 231, 233 and mixed, on the suction side (the upstream side) of the cooling fan 217 in the first passage 229, with the cooling air that has been heated by passing along the driving motor 201. As a result, the cooling air is cooled. The second passages 231, 233 are features that correspond to the "second cooling air passage" according to the invention. Specifically, as shown in FIG. 3, the upper second passage 231 is defined by an air intake 231*a*, a communication passage 231*b* and a space 235. The air intake 231*a* is formed by notching the retainer 317 disposed in the joint between the motor housing 105 and the gear housing 107. The communication passage 231*b* is formed by notching the baffle plate 221 such that it communicates with the air intake 231*a*. The space 235 is defined between the rear surface of the baffle plate 221 and the inner wall surface of the motor housing 105. Further, the lower second passage 233 is defined by an air intake 233*a* and the space 235 between the rear of the baffle plate 221 and the inner wall surface of the motor housing 105. The air intake 233*a* is formed through a bulged front portion 105*a* of the motor housing 105. The air intake 231*a* of the retainer 317 and the air intake 233*a* of the motor housing 105 have a slit-like shape elongated in the lateral direction of the body 103. The second passages 231, 233 communicate with the first passage 229 between the driving motor 201 and the baffle plate 221 on the suction side of the cooling fan 217.

Operation and usage of the above-described hand-held electric disc grinder 101 is now explained. When user hand-holds the motor housing 105 and operates the switch knob, the electric motor 201 is driven and the grinding wheel 313 is rotated, so that the operation of polishing or grinding workpiece can be performed. During the operation by the grinding wheel 313, cooling air is drawn into the motor housing 105 through the inlet by rotation of the cooling fan 217. Then, as shown by arrows in FIG. 1, the cooling air is led through the first passage 229 and discharged to the outside through the air outlets 227. The cooling air flowing through the first passage 229 cools the driving motor 201, the motor housing 105, the gear housing 107 and the power transmitting mechanism 301.

When the cooling air passes through the first passage 229, outside air is taken in through the second passages 231, 233. This intake of outside air is achieved by utilizing back pressure defined by pressure difference between the first passage 229 and the atmosphere. Specifically, the suction force of the cooling fan 217 acts upon the space 235 between the rear surface of the baffle plate 221 and the inner wall surface of the motor housing 105. By this suction force, outside air is taken into the motor housing 105 via the air intake 231*a* and the communication passage 231*b* or via the air intake 233*a*. The outside air that has been taken into the motor housing 105 joins and mixes with the cooling air flowing through the first passage 229, on the rear side of the baffle plate 221. When the cooling air passes along the driving motor 201 through the first passage 229, the cooling air is heated by the driving motor 201. However, as mentioned above, outside air flows in through the second passages 231, 233 and mixes with the heated cooling air, thereby cooling the cooling air. As a result, the gear housing 107 and the power transmitting mechanism 301, which are located downstream of the driving motor 201, can also be cooled by the cooled cooling air.

Further, according to this embodiment, the second passages 231, 233 are formed on the suction side of the cooling fan 217. In other words, the second passages 231, 233 are formed such that outside air is introduced between the cooling fan 217 and the driving motor 201. With such construction, the outside air is taken into the body 103 through the second passages 231, 233 and directly contacts with part of the motor housing 105 and the driving motor 201, thereby cooling the motor housing 105 and the driving motor 201. In the above-mentioned manner, the entire hand-held electric disc grinder 101, including the body 103 and the driving motor 201 and the power transmitting mechanism 301 disposed within the body 103 can be efficiently cooled. Thus, the user can perform the operation while holding the motor housing 105.

Further, in this embodiment, the air intake 231*a* of the upper second passage 231 is formed by notching the outer peripheral portion of the retainer 317 disposed in the joint between the motor housing 105 and the gear housing 107 when they are butt-joined together. With this construction, when the body 103 is viewed from above, only the bottom of the notch is visible through the air intake 231*a*. In other words, the retainer 317 serves as a screen to hide the inside of the housing, so that the inside of the motor housing 105 and the gear housing 107 is not visible or is difficult to see from outside. Thus, the inside of the body 103 is invisible from outside through the second passage 231. Therefore, although the second passage 231 for air intake is formed in the midsection in the longitudinal direction of the body 103, the appearance can be improved. Note that the inside visibility through the lower second passage 233 does not become a problem as long as it is not peeped into from below.

Second Representative Embodiment

Figure 4:
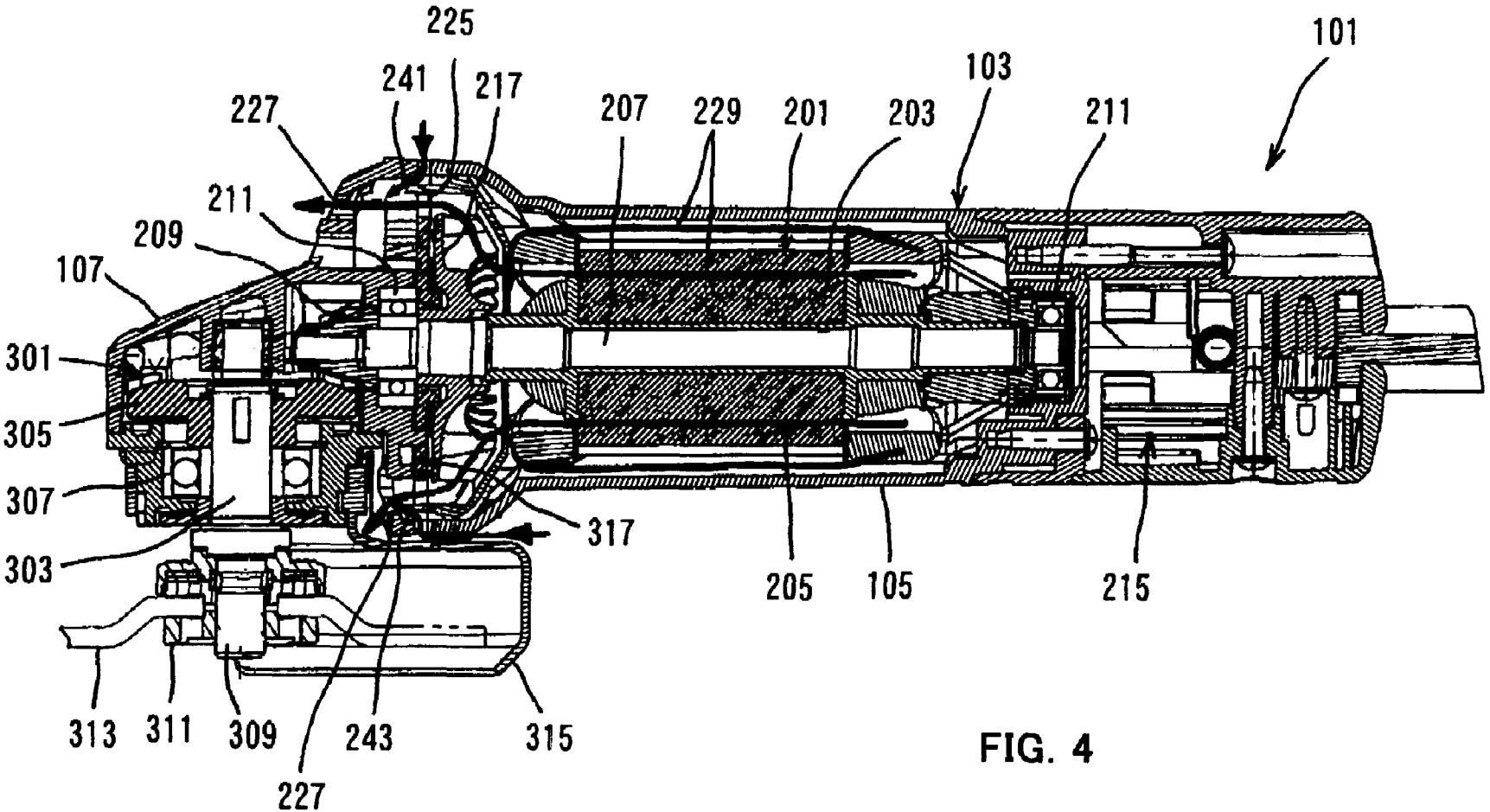
FIG. 4 is a sectional view showing the entire hand-held electric disc grinder according to the second representative embodiment of the invention.
Figure 5:
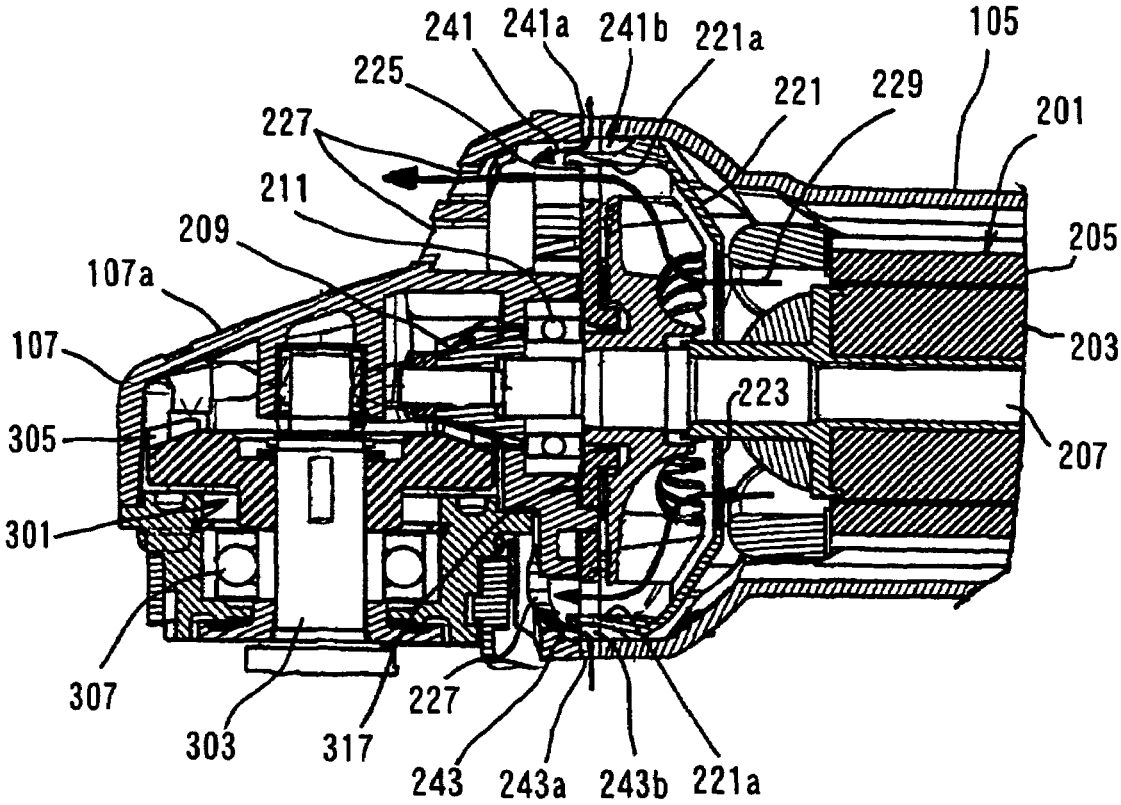
FIG. 5 is an enlarged partial view showing the second passage for intake of outside air.

Hand-held electric disc grinder 101 according to the second representative embodiment of the present invention is now explained with reference to FIGS. 4 and 5. The second representative embodiment is a modification relating to the second passages 231, 233 of the first embodiment. The other components are similarly configured as in the first embodiment and therefore, will be identified by the same numerals and will not be described. In the second embodiment, second passages 241, 243 are formed on the discharge side (the downstream side) of the cooling fan 217 on the upper and lower surface sides of the body 103. The second passages 241, 243 are features that correspond to the "second cooling air passage" according to the invention.

The second passages 241, 243 include air intakes 241*a*, 243*a* and communication passages 241*b*, 243*b*, respectively. The air intakes 241*a*, 243*a* are formed by notching the upper and lower peripheral portions of the retainer 317 disposed in the joint between the motor housing 105 and the gear housing 107. The communication passages 241*b*, 243*b* are defined by a clearance between the outside surface of an extension 221*a* of the baffle plate 221 and the inner wall surface of the gear housing 107. The baffle plate 221 corresponds to "baffle member" according to the invention. The extension 221*a* extends forward from the flange (the bowl-like outer circumferential edge region) of the baffle plate 221. The exit sides of the communication passages 241*b*, 243*b* face the space in the gear housing 107. The air intakes 241*a*, 243*a* have a slit-like shape elongated in the lateral direction of the body 103. Further, the outer circumferential surface of the baffle plate 221 contacts the inner circumferential surface of the motor housing 105 at the base of the extension 221*a*, thereby preventing communication between the first passage 229 and the second passages 241, 243.

In the electric disc grinder 101 thus constructed, when the cooling fan 217 is rotated, cooling air is drawn into the motor housing 105 through the inlet and flows within the motor housing 105 through the first passage 229. The cooling air is then led into the gear housing 107 and discharged to the outside through the air outlets 227. At this time, the cooling air that has passed through the air hole 223 of the baffle plate 221 is accelerated and flows forward in a strong current while being guided by the flange and the extension 221*a* of the baffle plate 221. This flow results back pressure to generate a suction force in the second passages 241, 243, so that outside air is taken in through the second passages 241, 243. The outside air joins and mixes with the cooling air flowing through the first passage 229, thereby cooling the cooling air. As a result, the gear housing 107 and the power transmitting mechanism 301 located downstream of the cooling fan 127 can also be cooled by the cooled cooling air.

Further, the extension 221*a* extends forward from the flange of the baffle plate 221 and defines the communication passages 241*b*, 243*b* of the second passages 241, 243. The extension 221*a* serves as a screen to hide the inside of the housing when the body 103 is viewed from above. In other words, the baffle plate 221 that defines the second passages 241, 243 also serves as a screen to hide the inside of the body 103 from view through the second passage 231. Therefore, although the air intakes 241*a*, 243*a* are formed in the midsection in the longitudinal direction of the body 103, the inside of the motor housing 105 and the gear housing 107 is hidden, so that the appearance of he tool can be improved.

Further, the air intakes 231*a*, 233*a* may be formed in the motor housing 105 in a position where they face the rear surface of the baffle plate 221 or the vicinity of the front end of the driving motor 201. Further, while the above embodiments are explained by using electric disc grinder, this invention can also be applied to power tools having a driving motor, a tool bit and a power transmitting mechanism such as a reciprocating saw, a chain saw, hammer and hammer drill.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

DESCRIPTION OF NUMERALS

101 electric disc grinder (power tool)
103 body (tool body)
105 motor housing
105*a* bulged front portion
107 gear housing
107*a* front upper surface
201 electric motor (driving motor)
203 rotor
205 stator
207 output shaft
209 driving side bevel gear
211 bearing
213 screw
215 electrical device
217 cooling fan
221 baffle plate (passage forming member)
221*a* extension
223 air hole
225 opening
227 air outlet
229 first passage (first cooling air passage)
231 second passage (second cooling air passage)
231*a* air intake
231*b* communication passage
233 second passage (second cooling air passage)
233*a* air intake
235 space
241 second passage (second cooling air passage)
243 second passage (second cooling air passage)
241*a* air intake
243*a* air intake
241*b* communication passage
243*b* communication passage
301 power transmitting mechanism
303 spindle
305 driven side bevel gear
307 gearing
309 grinding wheel mounting portion
311 grinding wheel holder
313 grinding wheel (tool bit)
315 cover
317 retainer (passage forming member)

We claim:

1. A power tool, comprising:

a driving motor, a tool bit that performs a predetermined operation on a workpiece, a power transmitting mechanism that transmits an output of the driving motor to the tool bit, a tool body that houses the driving motor and the power transmitting mechanism, a cooling fan disposed within the tool body, a first cooling air passage disposed within the tool body, the first cooling air passage flows cooling air into the tool body by using the cooling fan, a second cooling air passage provided within the tool body, the second cooling air passage takes outside air into the tool body by using the flow of the cooling air through the first cooling air passage to mix the outside air with the cooling air, and a baffle member that increases a back pressure by accelerating the cooling air within the first cooling air passage to urge the outside air being taken into the second cooling air passage.

2. The power tool as defined in claim 1, wherein the cooling air in the first cooling air passage cools the driving motor and flows downstream of the second cooling air passage after being cooled by mixing with the outside air taken into the tool body at the second cooling air passage.

3. The power tool as defined in claim 1, wherein the second cooling air passage takes the outside air into the tool body by the back pressure caused when the cooling air flows within the first cooling air passage.

4. The power tool as defined in claim 1, wherein the outside air taken into the second cooling air passage is mixed with the cooling air after the cooling air passes through the driving motor.

5. The power tool as defined in claim 1, wherein the second cooling air passage comprises members to define the passage and wherein at least one of the members hides an inside of the tool body from view through the second cooling air passage.

6. The power tool as defined in claim 1, wherein the tool body comprises a motor housing that houses the driving motor, a gear housing that houses the power transmitting mechanism, and a retainer provided within a connecting portion of the motor housing and the gear housing, the retainer hiding an inside of the tool body from view through the second cooling air passage.

7. The power tool as defined in claim 1, wherein the baffle member hides an inside of the tool body from view through the second cooling air passage.

8. The power tool as defined in claim 1, wherein the power tool is defined by a hand-held electric disc grinder.

9. A power tool, comprising:

a driving motor, a tool bit that performs a predetermined operation on a workpiece, a power transmitting mechanism that transmits an output of the driving motor to the tool bit, a tool body that houses the driving motor and the power transmitting mechanism, a cooling fan disposed within the tool body, means for flowing cooling air into the tool body by using the cooling fan, means for taking outside air into the tool body by using the flow of the cooling air through a first cooling air passage to mix the outside air with the cooling air, and a baffle member that increases a back pressure by accelerating the cooling air within the first cooling air passage to urge the outside air being taken into a second cooling air Passage.

10. A power tool, comprising:

a driving motor, a tool bit that performs a predetermined operation on a workpiece, a power transmitting mechanism that transmits an output of the driving motor to the tool bit, a tool body that houses the driving motor and the power transmitting mechanism, a cooling fan disposed within the tool body, a first cooling air passage disposed within the tool body, the first cooling air passage flows cooling air into the tool body by using the cooling fan, a second cooling air passage that takes outside air into the tool body by using the flow of the cooling air to mix the outside air with the cooling air, wherein the cooling air in the first cooling air passage cools the driving motor and flows downstream of the second cooling air passage after being cooled by mixing with the outside air taken into the tool body at the second cooling air passage, and a baffle member that increases a back pressure by accelerating the cooling air within the first cooling air passage to urge the outside air being taken into the second cooling air passage.

* * * * *